United States Patent [19]

Tremblay

[11] Patent Number: 4,605,024

[45] Date of Patent: Aug. 12, 1986

[54] METHOD AND APPARATUS FOR APPLICATION OF ARTIFICIAL FINGERNAILS

[76] Inventor: Gregory D. Tremblay, 437 1/2 Ninth St. #C, Sparks, Nev. 89431

[21] Appl. No.: 534,098

[22] Filed: Sep. 20, 1983

[51] Int. Cl.[4] ..... A45D 40/30

[52] U.S. Cl. ..... 132/88.5

[58] Field of Search ..... 132/73, 73.5, 88.5, 132/88.7, 1 R

[56] References Cited

U.S. PATENT DOCUMENTS

| | | | |
|---|---|---|---|
| 2,580,893 | 1/1952 | Dee | 132/88.5 |
| 2,592,293 | 4/1952 | Knepper et al. | 132/88.5 |
| 2,654,375 | 10/1953 | Frank et al. | 132/88.5 |
| 2,799,282 | 7/1957 | Slack | 132/88.7 |
| 4,172,461 | 10/1979 | Pangburn | 132/73 |

*Primary Examiner*—Robert Peshock

*Attorney, Agent, or Firm*—Herbert C. Schulze

[57] ABSTRACT

This invention is a method, and an apparatus for practicing the method, wherein human beings utilizing artificial fingernails may more easily and safely perform all of the necessary functions of fastening the artificial fingernails in place, sanding and otherwise shaping the artificial fingernails and utilizing such liquids and finishes as may be desired with safety and ease. The method is characterized by the utilization of shielding apparatus which performs the dual function of supporting the artificial nail which is adhering to the natural nail while at the same time covering the cuticle and other tender flesh areas in such manner that they are not damaged or irritated by the shaping and finishing of the artificial nails. The protecting and supporting device is caused to temporarily adhere to the users finger by means of appropriate clamping upon the finger.

3 Claims, 15 Drawing Figures

FIG. 1.
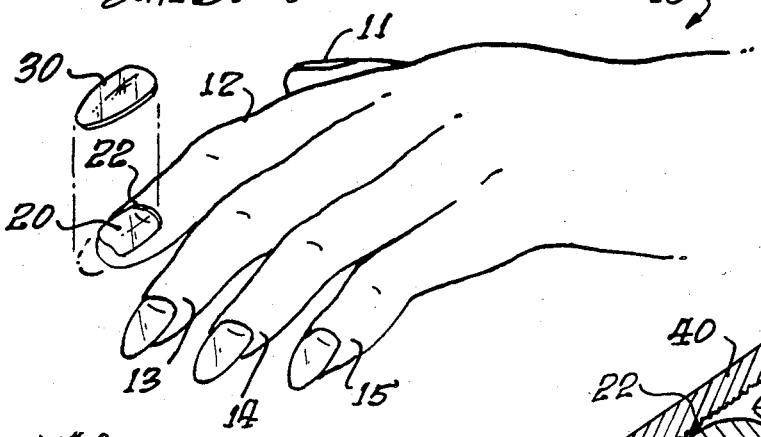
FIG. 4.
PRIOR ART
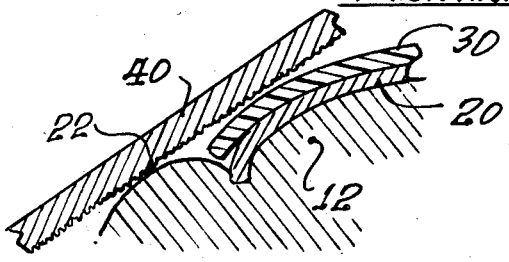
FIG. 1A.
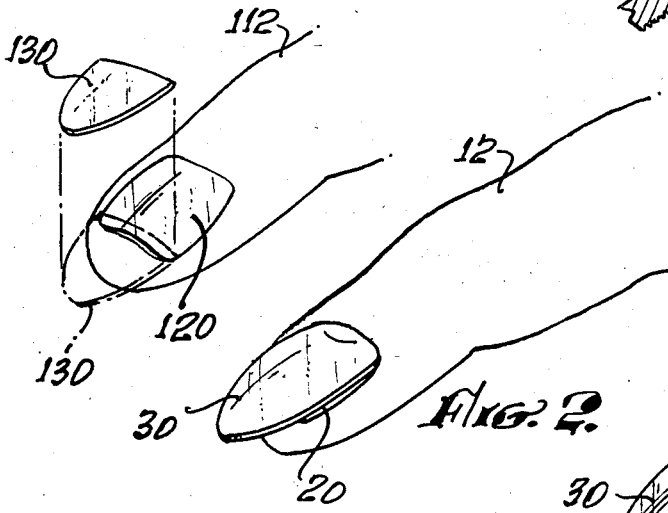
FIG. 2.
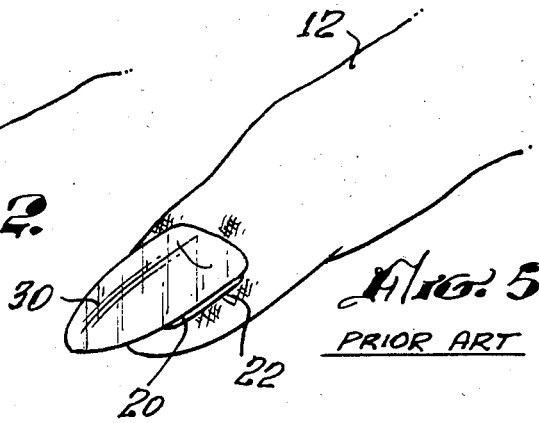
FIG. 5.
PRIOR ART
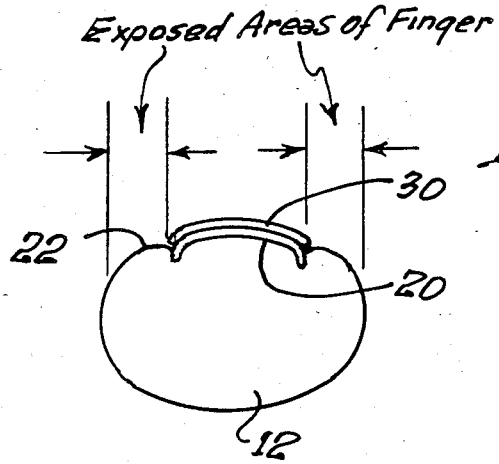
FIG. 3.

METHOD AND APPARATUS FOR APPLICATION OF ARTIFICIAL FINGERNAILS

CROSS REFERENCE TO RELATED PATENT APPLICATIONS

There are no patent applications related to this application filed by me.

BACKGROUND OF THE INVENTION

I. Field of the Invention

This invention is in the general field of personal health and appearance. The invention is more particularly directed to the care and appearance of the fingernails. The invention is even more directly related to a method and apparatus for the safe and convenient application of artificial fingernails to the natural fingernails. It includes a method for protecting cuticle and other areas around the natural fingernail from injury during the application and shaping of artificial fingernails, and at the same time provides support for the artificial fingernails, adhering to the natural nail, during the shaping and finishing process.

II. Description of the Prior Art

There is no prior art known to me by which an artificial fingernail is supported in place upon the natural nail during shaping and finishing operations and at the same time wherein the cuticle and other areas of the users finger about the area of application and of the artificial nail are protected from scratching or other injury. There have been some attempts to shield the cuticle and other areas about the area where the artificial nail is applied with adhesive material, or the like. Such shield items are normally suitable only for one use and do not combine an adjustable all purpose shield which incorporates a supporting apparatus for the nail, as well as protection from infections caused by adhesives and the like.

SUMMARY OF THE INVENTION

There is very wide use of artificial fingernails among women, and to a lesser degree among men. Such fingernails are generally of plastic or the like and are attached over the natural fingernail with adhesive of the like. The artificial nail blanks, generally speaking come in a variety of shapes and sizes, normally requiring triming and/or shaping and/or finishing with various liquids or colors or the like to achieve the desired appearance in each individual case.

In the shaping of artificial fingernails, emery boards, or the like, are used extensively. By the proper use of emery boards the artificial nail is caused to essentially blend rather perfectly with the natural fingernail and the finger of the user. During the shaping and finishing of the nail, however, it is quite common for the cuticle area and other adjoining areas to become abraded and painful. Such areas also can be affected by the application of adhesives and various liquids, including finishing colors and the like. It is relatively common for unpleasant, unsightly, and dangerous skin and flesh disorders and infections occur.

Some efforts have been made to partially alleviate this condition by the application of adhesive material or plastics to attempt to protect the cuticle areas and the like. Such arrangements are generally unsatisfactory since problems are caused in removal of such devices and, in addition, the finishing operations will frequently abrade right through such items in any event. Also, adhesives can cause serious infections.

Another problem in the application of artificial fingernails is that the nail itself may frequently become detached from the underlying fingernail by reason of the finishing operations. This is easily understood when it is recognized that the artificial nail normally extends considerably beyond the end of the natural nail and a good deal of leverage is applied to the end of the nail during the finishing operation.

I have studied this problem at length and have now conceived, and developed, a new and improved method for the application of artificial fingernails which method incorporates a shield which is adjustable to fingernail size and which is also supportive of the fingernail during the finishing procedures.

Since each person, and each fingernail, has individual characteristics, developing a method and apparatus to achieve the object desired became somewhat complex. I have accomplished the desired result, however, by providing a method for cooperatively and adjustably supporting the nail and simultaneously protecting the cuticle and other flesh areas virtually without regard to the shape or size of the finger upon which the artificial nail is being applied.

In developing the method I have also developed a particular apparatus for performing these functions, which comprises a clamp adapted to adjustably clamp to almost any finger. The clamp carries a pair of adjustable, appropriately shaped, members which can be adjusted in multi-directions so as to properly protect the vulnerable areas of the finger. The protective members further carry, at their ends, members suitable to support the artificial nail during the finishing procedure.

It is an object of this invention to provide a method, and means, cooperative with a finger and an artificial fingernail by which the nail is supported against being dislodged during finishing procedures on the nail.

Another object of this invention is to provide a method and apparatus of the nature described by which the cuticle and other flesh areas about the nail to which the artificial fingernail is being applied protected against injury caused by the application and finishing of an artificial fingernail.

Another object of this invention is to provide a method and apparatus by which an artificial fingernail being applied to a natural fingernail area may be supported during its application and finishing and at the same time the flesh areas adjoining the artificial nail being applied may be cooperatively protected against injury.

Another object of this invention is to provide support of such a nature that the shaping with an emery board or the like can be in the natural direction of the growth of the fingernail in order to enhance natural growth.

The foregoing and other objects and advantages of this invention will become clear to those skilled in the art upon reading the description of a preferred embodiment which follows, in conjunction with a review of the appended drawing.

BRIEF DESCRIPTIONS OF THE DRAWINGS

FIG. 1 Perspective of a hand and small portion of the wrist of an individual wherein artificial fingernails are being applied and showing one such artificial fingernail in an elevated position prior to application;

FIG. 1A Enlarged perspective of a finger showing an alternate shape and size artificial fingernail of common use;

FIG. 2 Enlarged view of finger 12 from FIG. 1 with the artificial nail in place upon the natural nail of that finger;

FIG. 3. An enlarged end view from the front of the finger of FIG. 2;

FIG. 4 A partial enlarged section of the view of FIG. 3 showing the manner in which damage occurs according to the prior art;

FIG. 5 View similar to FIG. 2 showing the damaged areas after completion of the shaping of the artificial fingernails;

FIG. 6. Perspective of a portion of a finger carrying an apparatus suitable to practice the method of this invention;

FIG. 7 Plan view of the finger and apparatus of FIG. 6 showing certain elements in phantom outline;

FIG. 7A Plan view of a portion of an alternately shaped supported element ;

FIG. 7B Another partial plan view of still another alternately shaped element utilizing the apparatus of FIG. 7;

FIG. 8 A view similar to FIG. 7 but with an alternate modification to the supportive and protective element and with an artificial fingernail in place;

FIG. 9 A section on 9—9 of FIG. 6;

FIG. 10 A section on 10—10 of FIG. 7;

FIG. 11 A section on 11—11 of FIG. 6;

FIG. 12 A section on 12—12 of FIG. 8.

DESCRIPTION OF A PREFERRED EMBODIMENT

FIG. 1 illustrates a persons hand generally 10 with fingers 11, 12, 13, and 14 and 15. In the particular illustration shown, some artifical fingernails have already been applied to fingers 13, 14 and 15. The finger 12 shows the normal finger nail 20 and the cuticle or fleshy area 22 about the fingernail. An artificial fingernail 30 is shown extended above the nail 20 ready to be applied with an adhesive on top of the natural nail 20.

FIG. 1A shows an alternate form of artificial fingernail wherein the finger 112 having natural nail 120 has a shortened artificial nail 130 which is placed and adhered to the very end of the natural nail 20 as is illustrated by the phantom lines.

FIG. 2 shows the finger 12 from FIG. 1 with the artificial nail 30 in place on top of the regular nail 20.

FIG. 3 is an end view on FIG. 2 which shows the exposed fleshy areas 22 about the natural and artificial nail.

FIG. 4 , in section, is explicitly to illustrate the danger from an emery board or the like 40 to the exposed fleshy areas such as 22. The emery board 40 is used to shape and finish the artificial nail 30.

FIG. 5 illustrates the damage which occurs by the shaded areas around the artificial nail and in the areas of the fleshy portion surrounding the nail, being principly area 22. The shaded areas are injured areas which have been abraded by the use of the emery board in finishing the artificial nail.

Figure 6:
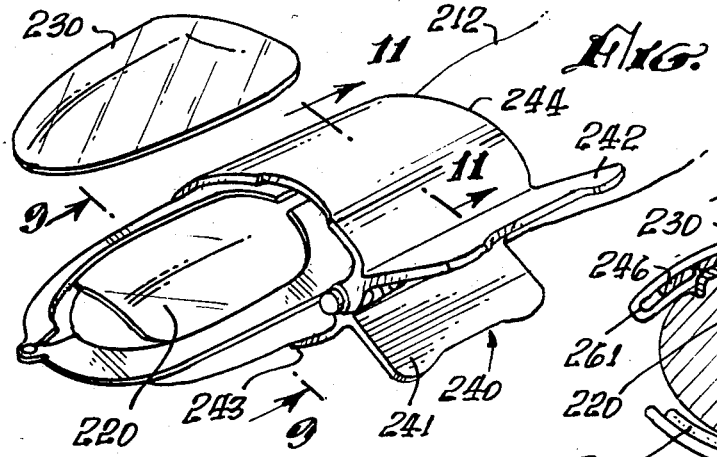
FIGS. 6 through 12 illustrate the advantages of my method and also illustrates a specific apparatus for performing my method of applying and finishing artificial nails.

FIG. 6 illustrates a mechanism generally 240 which can be used in this method. It is a spring actuated clamping device comprising a more curved portion 243 with suitable pad or the like 269 to press against the bottom of the finger. The upper portion of the clamp, 244 includes a shell 260 having elongated pockets 261 and 262 to receive elements 246 an 247 of the device.

The tabs 241 and 242 are for opening the clamp to place upon the finger. The spring mechanism generally 245 will be understood by those skilled in the art similar to any spring loaded clamp of this nature.

In FIG. 6, the natural nail 220 of finger 212 is shown with the artificial nail 230 elevated. This is for purpose of clarity and understanding the remaining views.

Figure 9:
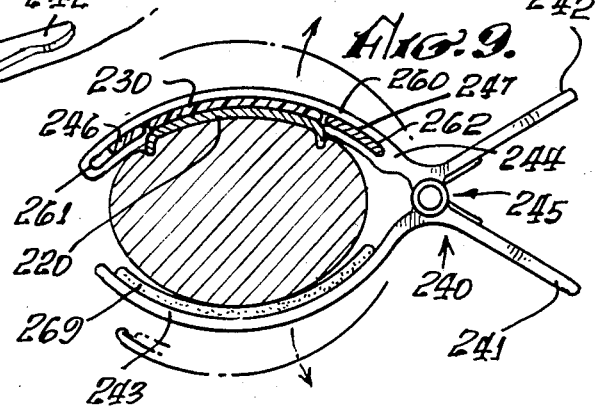

FIG. 9 has purposely been shown with the artificial fingernail 230 in place upon the natural nail 220 so that the actuation can be understood.

The phantom lines on FIG. 9 illustrate how the clamp is opened by pressure upon the two tabs 241 and 242.

Figure 7:
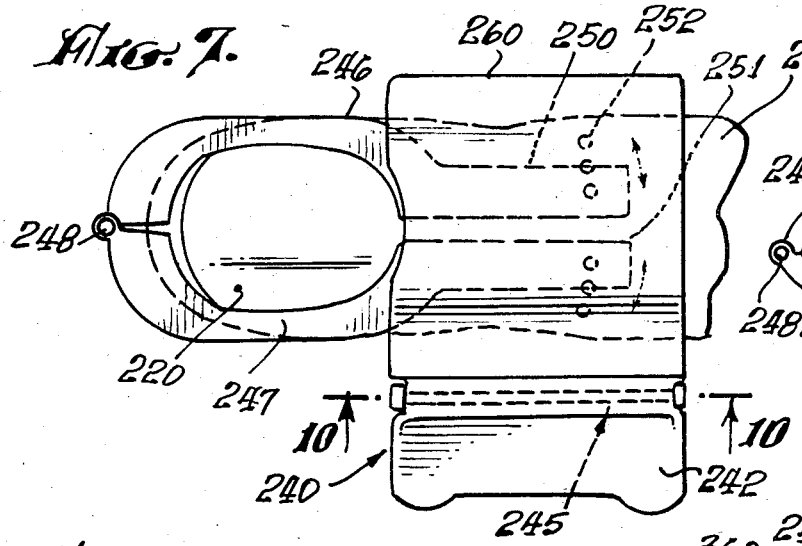

FIG. 7 shows how the two protective elements 246 and 247 are hinged at point 248 so that they may be moved toward each other or away from each other to accommodate different sizes of fingernails. Their extensions 250 and 251 are shown in phantom within the element packets 260–261 formed in the hollow number 244. A series of dedans (with matching indents if desired) 252 are shown in FIG. 7 in phantom to illustrate how pressure may be applied to the end tabs 250 and 251 to hold them in the desired position of open or closed configuration to best protect the fleshy areas desired to be protected by the device.

Figure 7A:
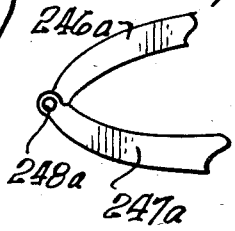
Figure 7B:
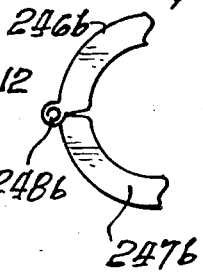
Figure 10:
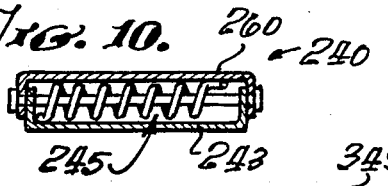

FIGS. 7A and 7B show the elements 246*a*, 247*a*, 248*a*, 246*b*, 247*b*, and 248*b* merely to illustrate alternate embodiments showing that different shapes san be applied to the basic elements 246 and 247 as desired to accommodate to varying conditions shapes and sizes of fingers.

Figure 8:
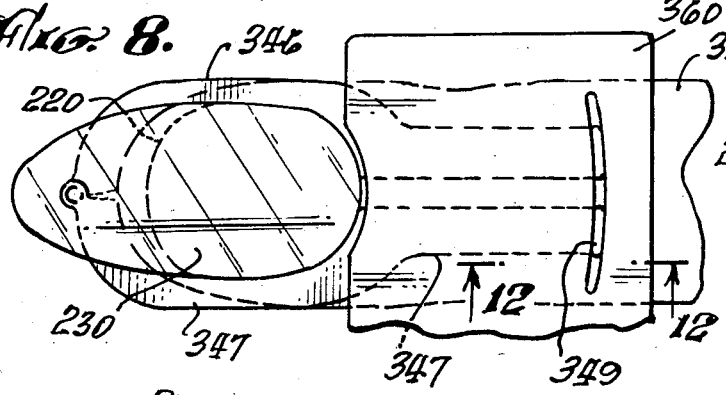
Figure 12:
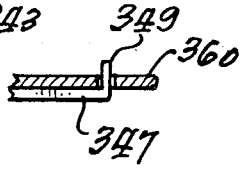

FIG. 8 shows the basic element as shown in FIG. 7 but in a slightly different configuration therefor utilizing similar numerals for the elements of the device to practice the method of my invention but in the 300 series insofar as the device itself is concerned. FIG. 8 also shows clearly the utilization of the front portion of the device to support the artificial nail so that it will not be broken loose during the finishing operations. The basic protective element 360, similar to the portion 260 of the illustration in FIG. 9, is shown to have a curvature at the lower portion of the nail to protect that fleshy area. It is also noted that the areas a tab 349 on the extension 347 ( and a similar one on the end extension 346) operating through a slot in the element 360 so that the exact positioning of the elements 346 and 347 can be controlled more easily. This will also be clear in the illustration FIG. 12.

Figure 11:
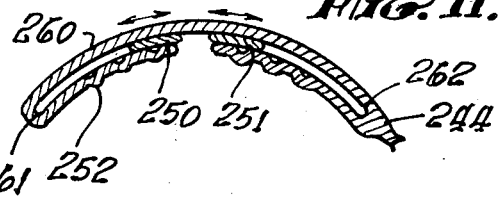

FIG. 11 shows the actuation of tabs 250 and 251 within the pockets 261 and 262 within the element 244 and its outer shell 260.

During actual use, the utilization of my method comprises placing the protective elements such as the elements 246 and 247 about the natural finger more or less as illustrated in FIG. 7 conforming to the curvature on a clamp or the like as shown. There are many different ways in which the protective elements could be clamped to the finger but the illustration shown illustrates one preferred device. After the elements 246 and 247 have been adjusted appropriately so as to protect the cuticle and fleshy areas about the nail 220, appropriate adhesive is applied and the artificial nail is then placed in position as is illustrated particularly in FIGS. 6 and 8. When the adhesive has taken its initial set, the artificial nail 230 may then be shaped with appropriate shaping instruments primarily emery boards and the like. The protective elements 346 and 347 are preferably made of a suitably hard material which will resist abrasion such as aluminum or the like. There is no restriction as to the material to be used so long as it will resist the abrasion of the emery board to a reasonable degree.

After the fingernail has been totally shaped, various liquids may be applied to provide appropriate desired colors and gloss as may be the particular preference of the person using the artificial nails. The protective elements 246 and 247 and the similarly numbered alternate illustrations will protect the cuticle and fleshy areas from injury as the entire operation has been performed with those areas protected by the device. At the same time, the fingernail will be supported by the front portion of the protective devices so that pressure of the emery board or the like will not cause it to have the artificial fingernail to break loose from the natural nail to which it adheres.

As illustrated with its adjustable nature, this apparatus can be adapted to be used in sequence upon each finger of a persons hand. It will be noted that the clamping arrangement will be large enough to encompass the largest finger of a normal hand as well as the smallest.

While the embodiment of this invention, which has been shown and described, is fully capable of achieving the objects and advantages desired, it is to be understood that this embodiment has been shown for purposes of illustration only and not for purposes of limitation.

I claim:

1. Apparatus for improved application of artificial fingernails comprising, in cooperative combination: protective shield means comprising a multiplicity of protective elements movably connected together in such manner as to be able to adjust to the configuration of the cuticle area of a fingernail suitable to be removably fastened to a finger in such manner as to encompass the cuticle area around a fingernail so as to prevent damage to the cuticle and flesh adjacent to the fingernail when an artificial fingernail is placed thereon and shaped by abrasion or the like and wherein at least one of the movable elements is suitable to support the end of an artificial fingernail at a distance from the end of the finger.

2. Apparatus for use in applying artificial fingernails to a natural fingernail comprising in combination clamping means suitable to clamp on a finger, said clamping means carrying an artificial fingernail support means; and protective means carried by said clamping means suitable to be located adjacent a portion of the cuticle area of the finger to which said clamping means may be clamped.

3. Apparatus for use in applying artificial fingernails to a natural fingernail comprising in combination clamping means suitable to clamp on a finger; and protective shield means carried by said clamping means suitable to be located adjacent a portion of the cuticle area of the finger to which said clamping means may be clamped, which protective shield means incorporates artificial fingernail support means.

* * * * *